United States Patent [19]

Hyatt et al.

[11] 4,088,424

[45] May 9, 1978

[54] WET PICK-UP VACUUM UNIT MOTOR BEARING AIR SEAL

[75] Inventors: Robert L. Hyatt, Tallmadge; Norbert H. Niessner, South Euclid, both of Ohio

[73] Assignee: Ametek, Inc., Kent, Ohio

[21] Appl. No.: 799,241

[22] Filed: May 23, 1977

[51] Int. Cl.[2] ..... F04B 39/06; A47L 9/22

[52] U.S. Cl. ..... 417/368; 417/373; 417/423 A; 15/413; 277/133

[58] Field of Search ..... 15/412, 413; 417/368, 417/423 R, 423 A, 373, 424; 277/3, 12, 133, 134, 226

[56] References Cited

U.S. PATENT DOCUMENTS

| | | | |
|---|---|---|---|
| 2,726,807 | 12/1955 | Lewis | 417/423 A |
| 3,733,150 | 5/1973 | Porter et al. | 417/423 A X |
| 3,780,397 | 12/1973 | Harbeck et al. | 15/413 |
| 3,866,263 | 2/1975 | Crouser et al. | 15/412 |
| 3,932,070 | 1/1976 | Porter et al. | 417/423 A |

FOREIGN PATENT DOCUMENTS

| | | | |
|---|---|---|---|
| 2,003,905 | 8/1971 | Germany | 15/413 |
| 2,341,233 | 2/1974 | Germany | 15/413 |

*Primary Examiner*—Robert S. Ward, Jr.
*Attorney, Agent, or Firm*—Albert L. Ely, Jr.

[57] ABSTRACT

A wet pick-up type vacuum motor fan unit with a separately ventilated motor section and a motor end bracket serving also as a support for, and part of a discharge end housing wall for, the working air fan section, has on the bracket fanward face a centrally apertured metal disk plate defining a flow space or path for bearing sealing air flow from ambient air inlets external of the motor section to a central discharge into the inlet eye of an auxiliary fan clamped on the shaft back-to-back with a larger diameter working air centrifugal fan adjacent the end bracket. A stamped shield cup jointly clamped on the shaft with the fans extends out of the auxiliary fan inlet eye into the disk central aperture, surrounding the shaft bearing socket of the bracket and being spaced from the disk aperture edge to afford a sealing air outlet from said space into the auxiliary fan inlet eye; whereby the disk plate and shield afford mechanical shielding, while air, discharging to and from the auxiliary fan, provides air shielding of the shaft and bearing area from working air entrained foam and moisture.

5 Claims, 1 Drawing Figure

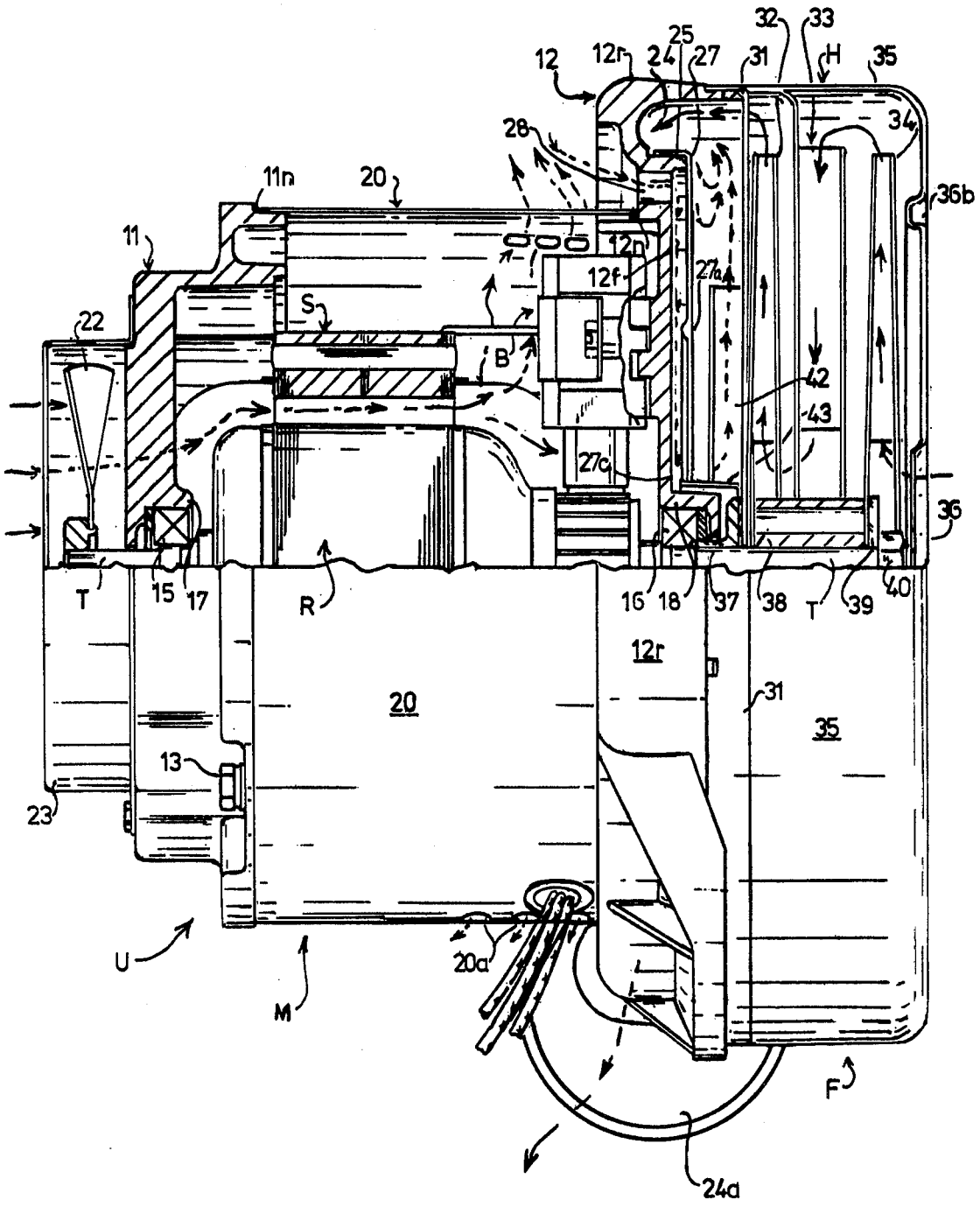
12
12r
24
25
27
31
32
33
H
35
34
36b
28
11n
20
11
12n
12f
27a
S
22
B
42
43
27c
36
T
15
17
R
16
18
37
38
T
39
40
12r
20
31
35
13
23
U
20a
M
F
24a

WET PICK-UP VACUUM UNIT MOTOR BEARING AIR SEAL

Generally in modern domestic and commercial electric vacuum cleaners or sweepers, a fan-driving electric motor and a centrifugal fan or fans, as suction fan means, for moving the working air or cleaning air through the cleaner, are incorporated into a motor-fan unit. The motor fan unit is intended as a unit to be assembled into or removable from the overall vacuum cleaner structure which further provides a dirt filter and receptacle, or, in wet pick-up types, a liquid receiver tank.

In wet pick-up floor or carpet cleaner equipment, especially the jet hot water extractor carpet cleaners, which have come into common use, and also in floor scrubbers where a vacuum pick-up of residual or rinse water is used, air-entrained water and dirt are separated from the working air, i.e., suction cleaning or transport air, before the working air stream reaches the suction fans of the apparatus, the separated liquid being either continually drained or withdrawn from the apparatus, or retained in a collection tank.

Now especially in operating jet hot water extractor carpet cleaners, there is applied to the carpet a water and detergent solution, which of course is ultimately to be picked up and sucked into the apparatus. By ordinary practice a "high foam" detergent is not used in such cleaning methods, and usually there is no troublesome foam generation or accumulation in the liquid or liquid collection tank of the cleaner apparatus. However, if the operator cleans a carpet which in fact had been previously cleaned with a high foam detergent or shampoo, or inadvertently uses a high foam detergent in his own cleaning operation, a considerable volume of foam may be generated which finds its way into the suction fans.

Though foam-suppressant compositions are available, and when a foam problem is present or probable, the cleaner operator is expected to use such a composition, especially in the liquid collection tank of a jet hot water extraction cleaner, the suppressant may be omitted or the problem may not be recognized in time. Hence by accident, and not by intent, foam or foam-generating liquid may pass into or through the suction fans of the cleaner. Thus detergent-carrying liquid or foam may find its way in part to the adjacent fan shaft bearing, from which it leaches out the lubricant with consequent and often quite rapid bearing damage.

When foam enters or is generated in the fan system, rather than leaving the fan housing cleanly at its normal working air discharge region, at least in part it may be caught and churned between the last fan and the adjacent bearing-supporting housing wall, in some instances the churning action expanding foams to a much larger volume; whence some part of the foam is then moved inwardly toward the shaft region and there past the ordinarily simple mechanical bearing seals. Very few occurrences of this sort are needed to result in a bearing lubricant loss to such extent that rapid bearing failure results.

By the present invention, to the final or working air discharging centrifugal fan there is clamped in back-to-back relation a smaller diameter auxiliary centrifugal fan to the central inlet eye of which there is introduced along the bearing and shaft region what may be termed "shielding" or "auxiliary" clean air. The auxiliary fan then discharges the "auxiliary" air circumferentially for sweeping foam, from the region between the fan housing wall and back of the working air fan, towards the working air outlet.

Further, a flat-bottomed cup-shaped rotary baffle or seal shield is commonly clamped on the shaft with, and in the inlet eye of, the auxiliary fan, thus surrounding the shaft portion leaving the adjacent bearing; in the case of a motor fan unit, extending towards the fanward end bracket face, also to surround a projecting bearing socket formation thereof. This affords further protection of the bearing region, especially where as in the preferred form a centrally apertured disk plate or baffle is secured on the fanward side of the fan housing end wall, i.e., the fanward end bracket face of a motor fan unit, to define an auxiliary or clean air flow space extending from angularly spaced fresh air inlets radially inward, towards the bearing region, to the central aperture as an annular outlet to the auxiliary fan inlet eye.

By this further somewhat elaborate structure, for the clean air flow, there is provided a further air and mechanical shield against foam or liquid movement to the bearing region, due to any minor recirculation of air from the auxiliary fan peripheral outlet to its central inlet, even under conditions of extreme foam loading.

The general object of the present invention is to provide, for wet pick-up type vacuum sweepers, cleaners and the like, a suction fan and bearing system including an improved safe-guard against foam or detergent reaching the fan shaft bearing region.

A further object is to provide, in an electric motor vacuum fan unit for wet pick-up type vacuum sweepers, cleaners and the like, a suction fan and bearing system including an improved safe-guard against foam or detergent reaching the fanward end bearing region of the motor and bracket.

A still further and more particular object of the present invention is to provide an electric motor vacuum fan unit of the character described, including an improved air seal for the bearing, whereby foam and detergent entrained in working air is prevented from gaining access to the fanward end bearing of the motor, there to leach out lubricant and hence to result in premature bearing failure.

Other objects and advantages will appear from the following description and the drawing which shows an electric motor vacuum fan unit generally of a type commonly used for vacuum sweepers and as well cleaners of the wet pick-up type, wherein the unit is shown partially in elevation and partially in longitudinal axial section.

The motor-fan unit U shown in the drawing has a general organization of known type being comprised of a separately ventilated motor section M and a vacuum fan section F, wherein working air moving centrifugal fans 32 and 34 are clamped directly on the motor rotor shaft T projecting from the motor section into the fan section housing.

In the motor section M, as the primary motor housing or stator structure, the left motor end bracket 11 and the right or fanward motor end bracket 12 are secured in engagment with opposite ends of a wound stator or field core structure S by field clamp bolts 13, extending through 11 and threaded into 12. The rotor R is supported to rotate within the field and stator structure by the shaft T with projecting right and left ends extending through appropriate bearing structures 15, 16 received in inwardly facing bearing sockets 17, 18; the rotor here being a commutating armature for which appropriate brush rigging, as indicated by the brush B, is mounted on the motor or inward face of the fanward end bracket 12.

Though series universal motors are commonly used, the invention, of course, is applicable to units with other motor sections of any appropriate electrical design, and also to units with mechanical variations; for example, brushing rigging could be supported on the left end bracket.

A punched metal band 20 is wrapped around annular shallow flat-bottomed receiving formations 11*n* and 12*n* on the end bracket members with its ends secured to each other, either permanently or in a readily removable manner, to form a motor housing circumferential closure, which is appropriately punched with air outlet apertures, particularly as at 20*a* for motor ventilating air exhausting over the commutator and brush region. By axial flow ventilation fan 22 secured on the left outboard end of the shaft T, that air is drawn in through numerous cooling air inlet apertures in the flat-ended, flange-rimmed cup-shaped ventilating fan cover 23, passing through apertures in the end bracket 11, and then; through the length of the motor section, especially between rotor and stator structure, for effective motor cooling.

In addition to serving as an end bracket for the motor as such providing the motor right end bearing socket 18, and providing support for the brushes, the member 12 first provides the inner end wall for the fan housing structure, generally indicated at H, and a rightwardly projecting rim 12*r* having a slight rabbetted annular rim portion for receiving a cup-shaped element as part of the fan housing H. Here, as shown further in the circumferential rim region of member 12, the particular form of fan housing and discharge further provides a scroll type expanding air outlet path including a channel 24 inward of the rim portion 12*r*, which is open axially to the right to receive air discharging from the periphery of the adjacent suction fan. The channel has a flow area continually increasing by increase in longitudinal, i.e., axial depth, as the channel approaches an outlet at discharge connection flange 24*a* integral with member 12.

The channel 24 is defined between an inner annular face of the rim portion 12*r* and a minor channel wall surface continued to the left from an annular bead 25. The inner circumferential wall of channel 24, hence bead 25, is about even with the outer, i.e., discharge, periphery of the second stage impeller 32.

Bead 25 is concentric with the shaft and projects from a main face of 12 to the right to sealingly receive and support the short axially flanged rim of a centrally apertured disk plate or baffle plate 27. Thus the disk 27 is spaced from the bracket flat end face 12*f* within that said bead; and it may be stiffened by annular groove 27*a*. The disk central outlet aperture 27*c* accommodates the right bearing socket 18 projecting therethrough and a shield structure 43, and affords an outlet to the inlet eye of fan 42 for auxiliary air entering at inlets 28, as hereinafter detailed.

Auxiliary air inlets 28 are provided through the end bracket wall at angularly spaced locations just within bead 27, thus lying at a location radially outward of band 20, hence effectively external of the motor housing structure.

The fan section F actually represents a two-stage design. The fan housing H conventionally includes shell structure fitted onto the exterior of the rim 12*r*, and here comprising two flat-bottomed cylindrical-walled drawn sheet metal shells 31 and 35. The shell portion 31, with its cylindrical wall fitted on the rim and surrounding the radially tapered second stage impeller 32, has a radial wall with a central opening as the inlet to the eye of the second stage impeller and having fixed on its outer or rightward face conventional stationary vanes 33. Thus the discharge periphery of impeller 32 is axially offset from the housing outlet therefor to discharge outwardly and then feed axially into the previously described channel 24.

For a first stage impeller 34 identical to impeller 32, the second shell portion 35 is telescoped onto a slightly reduced cylindrical end portion of 31, and in its basically flat-bottomed, i.e., radial wall region, has a large central inlet opening 36 for flow of working air axially to the first stage impeller inlet eye. A concentric annular inward beading 36*b* provides not only some structural rigidity for the end wall, but also a degree of pinching off the area between that housing front wall and the adjacent front end face of the impeller 34, to some degree to prevent recirculation from the impeller peripheral discharge area back to its inlet eye. Both the fans here are shown in a preferred radially tapering form now known to the art, comprising a main body disk centrally apertured for the shaft, an annular disk, and a series vane elements fixed therebetween.

Conventionally the first stage impeller 34 and second stage impeller 32 are secured on the rightwardly projecting end of the motor rotor shaft by means of a first axial spacer 37 including a sleeve portion about the shaft bearing against the inner race of ball bearing 16 and having a radial flange affording a clamping reaction surface for the main disk of fan 34; an elongated interstage spacer 38 between the impellers; an external washer 39 on the outer side of the first stage impeller body disk; and finally the clamping nut 40 threaded onto the shaft end.

The flow path of a working air from the inlet 36 of the housing H through the first stage impeller 34, the interstage "stationary fan" 33, the second stage working impeller 32, to the channel 24 leading to outlet 24*a*, is indicated by the solid arrows. The flow path of ventilating air for the motor is indicated by the dash-dotted direction arrows in the motor section.

Moreover, on the shaft T and between the flanged member 37 and the main disk of impeller 32, there are further clamped a "non-tapered" auxiliary fan 42 of appreciably smaller diameter than, and in back-to-back relation with, fan 32; and also a cup-shaped further baffle or shield element 43 centered in the eye of fan 42. It will be observed that the circumferential wall of shield member 43 has a fairly close running clearance about the rightwardly projecting bearing socket 18, and also extends axially through the central opening of the disk 27 towards flat fanward face 12*f* of end bracket 12. Thus the annular outlet, from the auxiliary air path or flow space defined between 27 and 12, in effect opens along the exterior surface of shield cup 43 into the eye of fan 42.

As indicated by the dotted arrow lines, the auxiliary air or bearing sealing air flows inwardly from the inlets 28, then axially past the bearing region into the eye of fan 42, and from the latter discharges, toward the main or working air outlet channel 24, through the space between the impeller 32 and the effective inner face of the fan housing, i.e., the disk plate 27. Thus a first obstacle to foam or detergent movement toward the bearing is provided by the auxiliary air discharging from fan 42; a second, by the flow of air through the outlet 27*c* around the shield 43 into the eye of fan 42; and a third and fourth, by the presence of the disk 27 forward of the face 12*f* in conjunction with the rotating cup shield both as extending into the central aperture 27*c* and also as surrounding the bearing socket.

What we claim is:

1. In a wet pick-up type vacuum cleaner fan unit with a cleaning working air centrifugal fan impeller mounted on a fan shaft supported in a lubricated bearing received in a central socket of a fan housing end wall, said impeller peripherally discharging to a working air outlet of the housing located adjacent to said end wall, the improvement comprising:

a centrally apertured disk plate circumferentially engaged and sealed upon and spaced from the fanward inner face of the said end wall;

a plurality of angularly spaced auxiliary or sealing air inlets through said wall from the exterior to an air flow space defined between the disk and end wall face;

an auxiliary centrifugal fan of smaller diameter than, and in back-to-back relation with, said working fan impeller, said auxiliary fan being clamped on said shaft with its inlet eye facing the central aperture of said disk to receive auxiliary air therefrom;

a shield cup received with circumferential spacing in the auxiliary fan inlet eye and having a centrally apertured flat bottom conjointly clamped with said fans on said shaft, and extending through the central aperture of the disk to define with the edge thereof a discharge outlet from said flow space into the auxiliary fan eye;

whereby said shield and disk provide structural screening around said bearing socket and shaft, and said auxiliary fan, shield and disk further moving auxiliary screening and sealing air axially exterior to the socket and on out to a common discharge of said back-to-back auxiliary and working air fans to prevent foam and working air entrained detergent from approaching said bearing.

2. A wet pick-up type vacuum cleaner fan unit improvement as described in claim 1, wherein the bearing-receiving central socket projects from said end wall toward the adjacent but axially spaced working air fan; and said shield cup has its circumferential wall surrounding the socket projection with running clearance.

3. A wet pick-up type vacuum cleaner fan unit improvement as described in claim 2, wherein said socket projects through the central aperture of said disk plate into the central inlet eye of the auxiliary fan.

4. A wet pick-up type vacuum cleaner fan unit improvement as described in claim 3, wherein the inner face of said end wall is provided with a circular bead concentric with the shaft and located radially outward of said air inlets;

said disk having a cylindrical short rim flange fitted over said bead thereby to secure and seal the disk to said end wall.

5. A wet pick-up type vacuum cleaner fan unit improvement as described in claim 1, wherein said end wall is an end bracket comprising part of a motor housing of an electric motor incorporated in said unit as a motor-fan unit; and the motor housing is ventilated by a cooling air stream separate from the working air stream.

* * * * *